United States Patent [19]

Naito

[11] Patent Number: 4,645,928

[45] Date of Patent: Feb. 24, 1987

[54] SWEEPING METHOD FOR SUPERIMPOSED-FIELD MASS SPECTROMETER

[75] Inventor: Motohiro Naito, Tokyo, Japan

[73] Assignee: JEOL Ltd., Tokyo, Japan

[21] Appl. No.: 743,016

[22] Filed: Jun. 10, 1985

[30] Foreign Application Priority Data

Jun. 19, 1984 [JP] Japan ..... 59-125745

[51] Int. Cl.[4] ..... H01J 49/26; H01J 49/32

[52] U.S. Cl. ..... 250/282; 250/283; 250/295; 250/296

[58] Field of Search ..... 250/296, 282, 295, 283

[56] References Cited

U.S. PATENT DOCUMENTS

| | | | |
|---|---|---|---|
| 3,870,881 | 3/1975 | Halliday et al. | 250/295 |
| 4,054,796 | 10/1977 | Naito | 250/295 |
| 4,521,687 | 6/1985 | Naito | 250/296 |
| 4,588,889 | 5/1986 | Naito | 250/296 |

*Primary Examiner*—Craig E. Church
*Assistant Examiner*—T. N. Grigsby
*Attorney, Agent, or Firm*—Webb, Burden, Robinson & Webb

[57] ABSTRACT

Detection of unknown daughter ions using a mass spectrometer in which two mass spectrometric units are coupled together. The spectrometric unit in the front stage has either an electric field or superimposed fields. The spectrometric unit in the rear stage has superimposed fields. The voltage $Vdx_2$ necessary to produce the electric field in the front stage and the voltage $Vdx_1$ necessary to produce the electric field of the superimposed fields in the rear stage when daughter ions having known mass and energy are detected are found. Further, the voltage $Vdx_2'$ necessary to produce the electric field in the front stage and the voltage $Vdx_1'$ necessary to produce the electric field of the superimposed fields in the rear stage when unknown ions are detected are found. Both the mass and the energy of the unknown ions can be determined from these four voltages.

3 Claims, 3 Drawing Figures

SWEEPING METHOD FOR SUPERIMPOSED-FIELD MASS SPECTROMETER

DESCRIPTION

BACKGROUND OF THE INVENTION

The present invention relates to an instrument in which two mass spectrometric units are coupled together and, more particularly, to a sweeping method for a mass spectrometer which has a front stage consisting of either superimposed fields or an electric field and a rear stage consisting of superimposed fields.

In an instrument in which two mass spectrometric units are coupled together (which will hereinafter be referred to as "MS/MS instrument"), parent ions having a specific mass are selected by the first mass spectrometric unit. The selected parent ions are caused to collide with neutral molecules in a collision chamber that is disposed in the ion path. Thus, the parent ions are dissociated, producing daughter ions which are introduced into the second mass spectrometric unit for mass analysis.

To attain a simplified structure of MS/MS instrument, an apparatus may be contemplated in which the second mass spectrometric unit consists of a single electric or magnetic field. Generally, however, when parent ions are split to produce daughter ions, the internal energy, generally known as translational energy, is released, and therefore the daughter ions have a wide range of energies. Accordingly, in cases where a single electric field is used as the second mass spectrometric unit, what can be measured is only energy in essence. In cases where a single magnetic field is employed as the second mass spectrometric unit, it is impossible to discriminate between the mass and the energy of daughter ions for measurement. In the latter case, therefore, an assumed energy is used for an ion or other means is utilized to accurately know the mass of the ion.

In view of the foregoing, the present inventor has already proposed a compact superimposed-field mass spectrometric unit as a second mass spectrometric unit (see U.K. Pat. No. 2,133,924 and U.S. patent application Ser. No. 458,756, filed Jan. 17, 1983). FIG. 1(*a*) shows the structure of the proposed instrument. FIG. 1(*b*) is a cross-sectional view taken on line A-A' of FIG. 1(*a*). This instrument has an ion source 1, an electric field 2, and a magnetic field 3 which together constitute a double-focusing mass spectrometric unit of normal arrangement. A collision chamber 5 is disposed at the position of ion convergence that is created by this first mass spectrometric unit. Magnetic poles 6 and 6' are mounted between the collision chamber 5 and a collector 4 to produce a magnetic field in the direction perpendicular to the page. The magnetic poles are excited by a magnetic field power supply 7. A pair of electrodes 8 and 8' produces a toroidal electric field in the direction perpendicular to the magnetic field. The voltage applied across the electrodes is generated by an electric field power supply 9. Auxiliary electrodes 10 and 10' which are known as Matsuda plates are mounted between the magnetic poles 6 and 6' so as to surround the toroidal electric field. A compensating power supply 11 applies a compensating voltage to the auxiliary electrodes. This superimposed-field mass spectrometric unit consisting of these components 6, 6', 7, 8, 8', 9, 10, 10', 11 is arranged as the second mass spectrometric unit.

As a sweeping method for this superimposed-field mass spectrometric unit, the aforementioned British patent discloses a sweeping in which the magnetic field intensity is changed between two levels, and at each level the electric field is swept. This method permits measurement of both the mass and the energy of daughter ions, but the spread of energy of daughter ions necessarily deteriorates the resolution. A better measuring accuracy is desired. Further, it is required that the magnetic field intensity be changed between two levels.

SUMMARY OF THE INVENTION

It is an object of the present invention to provide a sweeping method that improves the resolution of a superimposed-field mass spectrometer by the use of either an electric field or superimposed fields which precede other superimposed fields.

It is another object of the invention to provide a sweeping method which uses a superimposed-field mass spectrometer in which an electric field or superimposed fields precede other superimposed fields to measure both the mass and energy of unknown daughter ions without changing the magnetic field intensity.

The invention makes use of a superimposed-field mass spectrometer in which an electric field or superimposed fields precede other superimposed fields. It comprises a step of finding both the voltage $Vdx_2$ necessary to produced the electric field in the front stage and the voltage $Vdx_1$ necessary to produce the electric field of the superimposed fields in the rear stage when daughter ions having known mass and energy are detected. It comprises the step of finding the voltage $Vdx'_2$ necessary to produce the electric field in the front stage when unknown daughter ions are detected. It comprises the step of finding the voltage $Vdx'_1$ necessary to produce the electric field of the superimposed fields in the rear stage, and determining the mass and energy from these four voltages. The invention is hereinafter described in detail by referring to the accompanying drawings.

BRIEF DESCRIPTION OF THE DRAWINGS

FIG. 1(*b*) is a cross-sectional view taken on line A-A' of FIG. 1(*a*)

PREFERRED EMBODIMENTS OF THE INVENTION

Figure 1:
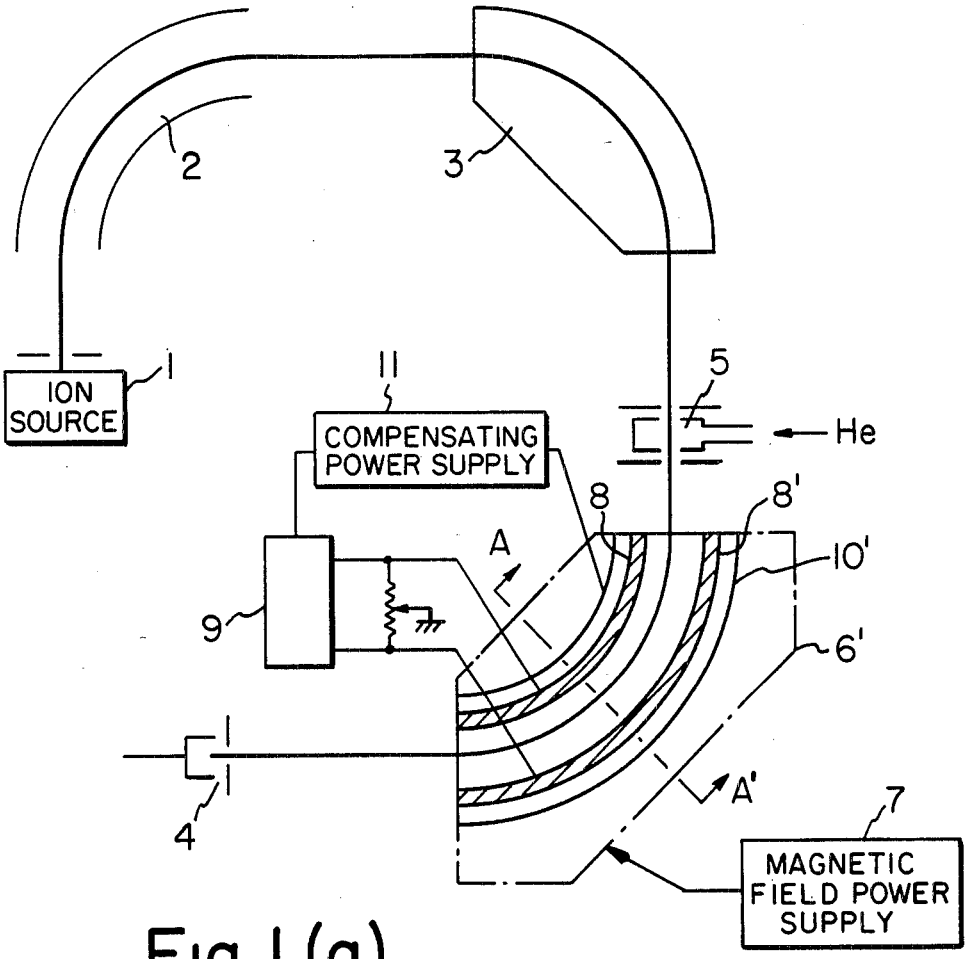
Fig. 1 (a) PRIOR ART
FIG. 1(*a*) is a diagram of a conventional MS/MS instrument in which the rear (last stage) is formed by a superimposed-field mass spectrometric unit.
Figure 1:
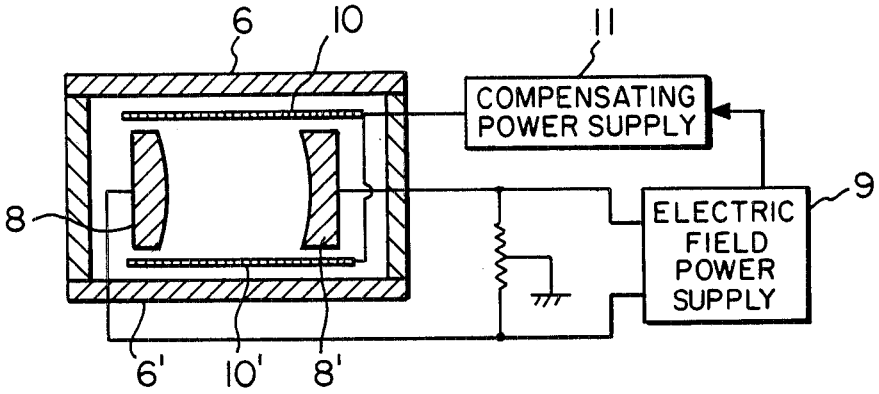
Fig. 1 (b) PRIOR ART
Figure 2:
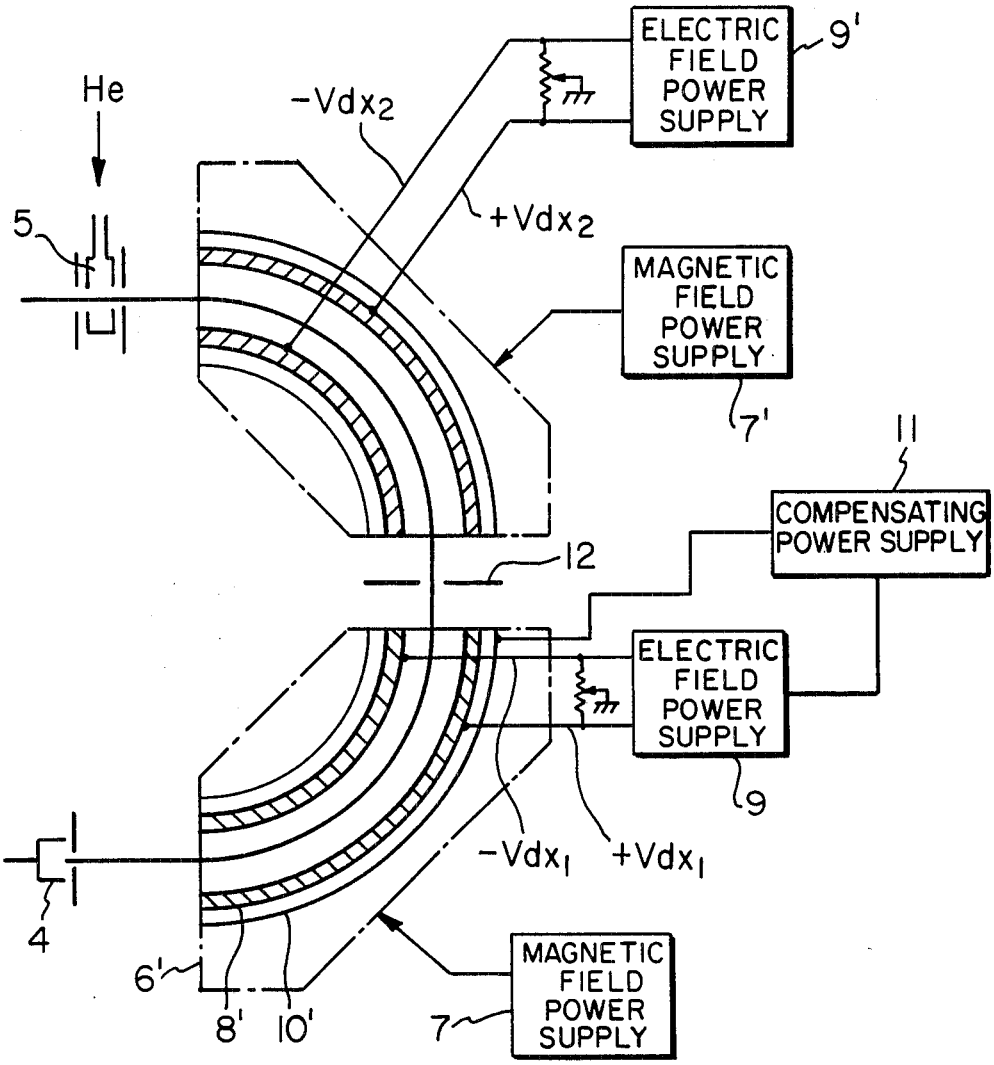
FIG. 2 is a diagram of a superimposed-field mass spectrometer for use in the present invention.

Referring to FIG. 2, there is shown a superimposed-field mass spectrometer for use in the present invention. This spectrometer is similar to the mass spectrometer shown in FIGS. 1(*a*) and 1(*b*) except that a second set of superimposed fields which is exactly the same as the first set of superimposed fields is set up in front of the first set of superimposed fields. The components which precede the collision chamber 5 are omitted, because they are the same as the components of FIGS. 1(*a*) and 1(*b*). A magnetic field power supply 7' and an electric field power supply 9' are used to develop the second set of superimposed fields.

Inside the collision chamber 5, parent ions $m_0^+$ are dissociated into daughter ions and neutral particles. We now assume that when the internal energy is released and when it is not released, the produced daughter ions are indicated by $m_x'^+$ and $m_x^+$, respectively. Under the condition of a constant magnetic field intensity, the voltage for producing the electric field of the superimposed fields is varied to focus ions $m_x$ or $m_x'$ onto the fixed collector. We now discuss the first set of superimposed fields. With respect to the conditions in which daughter ions $m_x+$ follow the central orbit in the superimposed fields as a central beam, we define the following symbols:

Vdx: Voltage for producing the electric field of the superimposed fields.

$B_0$: Intensity of the magnetic fields of the superimposed fields.

a: Radius of curvature at which ions are deflected in the superimposed fields.

$a_e$: Radius of curvature at which ions are deflected when only the electric field is produced.

$a_m$: Radius of curvature at which ions are deflected when only the magnetic field is produced.

With respect to the conditions in which daughter ions $m_x'+$ follow the central orbit in the superimposed fields as a central beam, we define the following symbols:

Vdx': Voltage for producing the electric field of the superimposed field.

$B_0$: Intensity of the magnetic field of the superimposed fields.

a: Radius of curvature at which ions are deflected in the superimposed fields.

$a_e'$: Radius of curvature at which ions are deflected when only the electric field is produced.

$a_m'$: Radius of curvature at which ions are deflected when only the magnetic field is produced.

Now let us assume that the following equations hold for daughter ions $m_x'+$:

$$m_x'=m_x(1+\gamma) \tag{1}$$

$$U_x'=U_x(1+\delta_e') \tag{2}$$

$$Vdx'=Vdx(1+\delta dx) \tag{3}$$

where $\gamma$, $\delta_e$, and $\delta dx$ are all sufficiently smaller than unity.

It is assumed that parent ions $m_0+$ and daughter ions $m_x+$ have a velocity of $V_x$ and that daughter ions $m_x'+$ have a velocity of $V_x'$. Then, we can have $$U_0=m_0V_x^2/2 \tag{4}$$

$$U_x=m_xU_x^2/2 \tag{5}$$

$$U_x'=m_x'V_x'^2/2 \tag{6}$$

With respect to daughter ions $m_x+$ in the electric field of the superimposed fields, we can get $$m_xV_x^2/a_e=-eVdx/d \tag{7}$$

$$m_x'V_x'^2/a_e'=-eVdx'/d \tag{7'}$$

In the above equations, d is the distance between the electrodes.

With respect to daughter ions $m_x+$ in the magnetic field of the superimposed fields, we can have $$m_xV_x^2/a_m=-eV_xB_0 \tag{8}$$

With respect to daughter ions $m_x'+$ in the magnetic field of the superimposed fields, we have $$m_x'V_x'^2/a_m'=-eV_x'B_0 \tag{8'}$$

Equations (8) and (8') are modified as follows:

$$\sqrt{2\,m_x\,U_x}\;/a_m = e\,B_0 \tag{9}$$

$$\sqrt{2\,m_x'\,U_x'}\;/a_m' = e\,B_0 \tag{9'}$$

Noting that the radius of curvature at which ions are deflected is a and making use of equations (7), (7'), (8) and (8'), $$\begin{aligned} 2\,U_x/a &= -e\,Vdx/d + e\,V_xB_0 \\ &= 2\,U_x/a_e + 2\,U_x/a_m \end{aligned} \tag{10}$$

$$\begin{aligned} 2\,U_x'/a &= -e\,Vdx'/d + e\,V_x'B_0 \\ &= 2\,U_x'/a_e' + 2\,U_x'/a_m' \end{aligned} \tag{10'}$$

Thus, we can have $$1/a=1/a_e+1/a_m \tag{11}$$

$$1/a=1/a_e'+1/a_m' \tag{11'}$$

From equations (7), (7'), (9), and (9'), the following relations are derived:

$$1/a_e = -e\,Vdx/2\,dU_x \tag{12}$$

$$1/a_e' = -e\,Vdx'/2\,dU_x' \tag{12'}$$

$$1/a_m = e\,B_0/\sqrt{2\,m_x\,U_x} \tag{13}$$

$$1/a_m' = e\,B_0/\sqrt{2\,m_x'\,U_x} \tag{13'}$$

By substituting equations (12), (13) and (12'), (13') into equations (11) and (11'), respectively $$1/a = -e\,Vdx/2\,dU_x + e\,B_0/\sqrt{2\,m_x\,U_x} \tag{14}$$

$$1/a = -e\,Vdx'/2\,dU_x + e\,B_0/\sqrt{2\,m_x'\,U_x'} \tag{14'}$$

By substituting equations (1), (2), and (3) into equation (14') and neglecting minute amounts of second and more orders, $$1/a\simeq(1/a_e+1/a_m)+(\delta_e-\delta_{dx})/a_e-(\delta_e+\gamma)/2a_m \tag{15}$$

From equation (11), we can get the relation $$1/a_e+1/a_m=1/a$$

Therefore, equation (15) can be put into the simpler form $$\delta dx=\delta_e(1+a_e/2a_m)+a_e\gamma/2a_m \tag{16}$$

Let $V_{00}$ be the voltage necessary to produce the electric field of the superimposed fields for detecting ions having infinitely large mass having an energy $U_x$. Then, we have $$a/a_e=Vdx/V_{00} \tag{17}$$

Combining equation (17) with equation (11), $$a_e/a_m=V_{00}/Vdx-1 \tag{18}$$

By substituting equation (18) into equation (16), eliminating $a_e/a_m$, and arranging the resultant formula, $$(Vdx/V_{00})\delta dx=(\delta_e/2)(Vdx/V_{00}+1)+(\gamma/2)(1-Vdx/V_{00}) \quad (19)$$

From equation (3), we can obtain $$Vdx\delta dx=Vdx'-Vdx$$

Let us define that $\Delta Vdx=Vdx'-Vdx$. Then, equation (19) can be arranged as follows:

$$2\Delta Vdx/V_{00}=\delta_e(Vdx/V_{00}+1) \quad (20)$$

This equation (20) shows the relation of the increment $\Delta Vdx$ in the voltage for producing the electric field of the superimposed fields to the minute quantities $\gamma$ and $\delta_e$. The increment is needed to focus unknown daughter ions $m_x'^+$ onto the collector, the unknown daughter ions existing near daughter ions $m_x^+$ which are focused onto the same collector after following the central ion orbit.

Although we have discussed only one set of superimposed fields, equation (20) holds for each of the two sets of superimposed fields shown in FIG. 2. With respect to the first set of superimposed fields, subscript "2" is added to equation (20). With respect to the second set of superimposed fields preceding the first set of fields, subscript "1" is added to equation (20). Thus, we have $$2\Delta Vdx_1/V_{001}=\delta_e(Vdx_1V_{001}+1)+\gamma(1-Vdx_1/V_{001}) \quad (21)$$

$$2\Delta Vdx_2/V_{002}=\delta_e(Vdx_2/V_{002}+1)+\gamma(1-Vdx_2/V_{002}) \quad (21')$$

Note that $\delta_e$ and $\gamma$ contained in equations (21) and (21') are unknown, while $\Delta Vdx_1$ and $\Delta Vdx_2$ can be found by measurement. If $Vdx_1/V_{001}$ and $Vdx_2/V_{002}$ in the above two equations are not equal, i.e., $Vdx_1/V_{001}\neq Vdx_2/V_{002}$, then the unknown $\delta_e$ and $\gamma$ can be found by using the above two equations as simultaneous quadratic equations.

A measurement using the sweeping method whose concept has been described thus far is made in the manner described below. First, the voltages for producing the electric fields of the two sets of superimposed fields are so adjusted that reference daughter ions $m_x^+$ having known mass $m_x$ and energy $U_x$ arrive at the collector and are detected after passing through the two sets of superimposed fields. The voltages $Vdx_1$ and $Vdx_2$ obtained in this way are recorded.

Then, the voltages for developing the electric fields are so adjusted that daughter ions having unknown mass and energy reach the collector and are detected after passing through the two sets of superimposed fields. The voltages $Vdx_1'$ and $Vdx_2'$ derived in this manner are recorded.

Subsequently, $\Delta Vdx_1$ and $\Delta Vdx_2$ are found using the values of $Vdx_1'$, $Vdx_2'$, $Vdx_1$, $Vdx_2$ obtained in this fashion. The found $\Delta Vdx_1$, $\Delta Vdx_2$ and $Vdx_1$, $Vdx_2$ are inserted into equations (21) and (21'). The equations are then solved for unknown $\delta_e$ and $\gamma$.

Thereafter, the obtained values of $\delta_e$, $\gamma$, and the values of the known $m_x$, $U_x$ are introduced into equations (1) and (2) to find the mass $m_x'$ and the energy $U_x'$ of the unknown daughter ions.

In this measurement, only those ions which travel along the central orbit of the superimposed fields in the front stage are guided into the superimposed fields in the rear stage. Therefore, an intermediate slit 12 is required to be disposed either on the central ion path or at the position at which an intermediate image is formed between the two sets of superimposed fields.

As a modified example, only an electric field is set up instead of the superimposed fields as shown in FIG. 2, in the front stage of the rear superimposed fields. This arrangement is equivalent to the arrangement of FIG. 2 in which the magnetic field intensity of the front superimposed fields is set to zero, i.e., $a_m=\infty$. In this case, $Vdx/V_{002}$ assumes a value of 1 and so the mass and the energy of unknown daughter ions can be found in exactly the same manner as the foregoing by substituting the relation $V_{002}=1$ into equation (21') above.

As thus far described in detail, the invention permits one to find both mass and energy of unknown daughter ions without changing the intensity of the magnetic field.

I claim:

1. A sweeping method for detecting daughter ions originating from parent ions by the use of a mass spectrometer having a rear stage having superimposed fields that consist of a magnetic field B and an electric field E perpendicular to the magnetic field, the mass spectrometer also having at least another electric field in a front stage in front of said rear stage having said superimposed fields, said sweeping method comprising the steps of:

(a) detecting reference ions having known mass and known energy;

(b) finding the voltage $Vdx_2$ necessary to produce the electric field in said front stage and the voltage $Vdx_1$ necessary to produce the electric field of the superimposed fields in said rear stage when the reference ions are detected;

(c) varying the voltages necessary to produce the electric field in said front stage and the electric field of the superimposed fields in said rear stage while maintaining the intensity of the magnetic field of the superimposed fields constant to detect unknown ions;

(d) finding the voltage $Vdx_2'$ necessary to produce the electric field in said front stage and the voltage $Vdx_1'$ necessary to produce the electric field of the superimposed fields in said rear stage when the unknown ions are detected; and (e) determining the mass and energy of the unknown ions from the voltages $Vdx_1$, $Vdx_2$, $Vdx_1'$, $Vdx_2'$.

2. A sweeping method as set forth in claim 1, wherein another set of superimposed fields is produced in said front stage in front of said rear stage having said superimposed fields that consist of the magnetic field B and the electric field E perpendicular to the magnetic field B.

3. A sweeping method as set forth in either claim 1 or claim 2, wherein an intermediate slit is disposed either in a central ion path or in the position at which an intermediate image is formed between said rear stage and said front stage.

* * * * *